United States Patent [19]

Beruto et al.

[11] 4,369,245

[45] Jan. 18, 1983

[54] PHOTOGRAPHIC ELEMENT FOR TANNING DEVELOPMENT AND METHOD FOR OBTAINING COLORED RELIEF IMAGE

[75] Inventors: Marco Beruto; Piero Ramello, both of Savona, Italy

[73] Assignee: Minnesota Mining and Manufacturing Company, St. Paul, Minn.

[21] Appl. No.: 299,726

[22] Filed: Sep. 8, 1981

[30] Foreign Application Priority Data

Jul. 28, 1980 [IT] Italy ..... 49360 A/80

[51] Int. Cl.[3] ..... G03C 1/76; G03C 1/06

[52] U.S. Cl. ..... 430/264; 430/306; 430/405; 430/495; 430/517; 430/539; 430/566; 430/961

[58] Field of Search ..... 430/264, 301, 302, 306, 430/405, 495, 566, 517, 505, 539, 961, 949, 950

[56] References Cited

U.S. PATENT DOCUMENTS

| | | | |
|---|---|---|---|
| 3,276,871 | 10/1966 | Abbott | 430/517 |
| 3,364,024 | 1/1968 | Yackel et al. | 430/202 |
| 3,864,129 | 2/1975 | Schober | 430/405 |
| 3,989,522 | 11/1976 | Poot et al. | 430/264 |
| 4,029,509 | 6/1977 | Blake | 430/495 |
| 4,233,392 | 11/1980 | Friedel | 430/264 |

*Primary Examiner*—Mary F. Downey

*Attorney, Agent, or Firm*—Cruzan Alexander; Donald M. Sell; Mark A. Litman

[57] ABSTRACT

A photographic element for tanning development which comprises a support, a layer of silver halide emulsion in non-hardened gelatin including a tanning developer dispersed therein, and over said emulsion layer, a layer of non-hardened gelatin comprising at least one colored pigment dispersed therein, characterized by the silver in said silver halide emulsion layer being present in a quantity of less than 0.6 g/m$^2$ with a silver/gelatin ratio of less than 0.4. A method for obtaining a colored relief image in such an element is shown.

9 Claims, No Drawings

PHOTOGRAPHIC ELEMENT FOR TANNING DEVELOPMENT AND METHOD FOR OBTAINING COLORED RELIEF IMAGE

TECHNICAL FIELD

This invention relates to a silver halide photographic element for use with a method for image formation by tanning development. It is known in the art that image formation methods using tanning development are based on the fact that in the presence of exposed silver halide, certain compounds, known as tanning developers, oxidize in an alkaline environment to give gelatin hardening compounds. It is thus possible, with the known methods of the art, to obtain relief images of gelatin which have been used, for example, in matrix methods of the Technicolor type.

Although such methods of the art have been studied in depth, they have not found commercial application to an extent proportional to the research effort expended.

BACKGROUND ART

For the purpose of colored relief image formation, it has been proposed to use colored materials (especially carbon) dispersed in the non-sensitive layer of a two layer tannable construction such as that shown in U.S. Pat. No. 3,364,024. Of the various tanning developers, comprising pyrogallol, catechol, hydroquinone and its derivatives and gallic acid, as described, for example, by R. B. Pontius in PSA Journal, Section B, September 1951, pages 76–79 and by A. G. tull in *The Journal of Photographic Science,* Vol. 11, 1963, pages 1–26, the hydroquinone and some of its derivatives have been described as the most useful or even the only useful substances for satisfying the material and method requirements as heretofore stated.

In spite of this, and as already stated, tanning development methods have not found significant practical application. As these methods have always been regarded as a means for reducing silver consumption in the photographic industry, and considering the considerable cost increase undergone by silver in the course of time, it can be deduced that such methods do not give satisfactory results.

The conclusion of certain experiments and technical considerations made by the applicants was that constructions with the emulsion layer below the pigmented layer did not seem promising because of the fact that the pigmented, non-sensitive layer (NSL) would absorb part of the exposure light and thus present a low efficiency system which would be remedied only by higher silver contents. Likewise, although using a top coat of emulsion over the pigmented layer allows for smaller silver quantities, the reliefs obtained were not as sharp as required. The use of separate elements with an emulsion on one and a pigmented layer on the other is too complicated to be of commercial interest.

DISCLOSURE OF THE INVENTION

Applicants have discovered that the characteristics of the first above described type of element with a pigment, even a black pigment, in its non-sensitive outer layer, are improved if the silver in the sensitive layer is reduced both in terms of absolute value and in terms of its proportion with respect to the quantity of gelatin present in the layer.

The present invention describes a photographic element including a support, a sensitive layer of silver halide in gelatin spread thereover, and a non-sensitive gelatin layer spread over said former layer. A tanning development agent is included in said emulsion layer (dispersed in said layer into which it is introduced in known manner in aqueous solution, for example, in a 5 or 7% solution in the case of hydroquinone), and a colored pigment (carbon or organic pigment) is included in said non-sensitive layer. It has been found that the image quality obtained by exposure and development in an alkaline bath are improved if the silver content is less than 0.6 grams per square meter, preferably less than 0.5 and more preferably less than 0.4, even more preferably lies between 0.2 and 0.4, and if at the same time the silver-gelatin weight ratio in the sensitive layer is less than 0.4, preferably less than 0.3, more preferably less than 0.2 and even more preferably lies between 0.05 and 0.15.

Applicants have shown that a silver halide emulsion containing a significant quantity of chloride, for example, a quantity of at least 10%, and preferably between 10 and 70%, the rest of the halides being bromide, gives the best results within the scope of the present invention, the absence of iodide being normally preferable to its presence, even in small quantities.

The choice of the tanning development agent has not been found to be as critical as described in the aforesaid U.S. Pat. No. 3,364,024, in the sense that even catechol was found useful for the purpose of the present invention, even though hydroquinone was found to be preferable because of its wider range of action combined with the greater stability of its oxidation product, as, for example, described in "Theory of Tanning Development" by W. H. Evans at the RPS Centenary Conference 1953, the summary of which is given in *Science et Industrie Photographique,* No. 5, 2nd Series, page 357, of September 1953, and also because of its lower cost.

Particularly useful for the purpose of the present invention has proved to be a protective gelatin layer spread over said non-sensitive gelatin layer containing the pigment or colored material, this layer improving the quality both of the coating and of the resolution of points or lines (particularly in graphic arts for lithographic materials in which images are obtained by points or lines).

For the purpose of the present invention, the presence of the tanning agent in the light sensitive layer has been found significant, in that it must be present in a sufficient quantity to ensure tanning of the pigmented layer, both in relation to the quantity of silver halide and in relation to the thickness (i.e., the gelatin quantity) of the sensitive layer which contains it. For those silver/gelatin values which are most useful for the purpose of the present invention, it has been found that gelatin/tanning agent weight values which are particularly useful for the purpose of the present invention are those which lie between 3 and 8, preferably between 5 and 7, and more preferably between 5.5 and 6.5 (said values being calculated in particular for hydroquinone). In determining the optimum tanning agent quantity, experiments of the applicant have shown that excessive quantities lead to partial tanning even of the non-exposed zones, this in the case of graphic art applications leading to a smaller exposure range and a worsening of the point quality.

With regard to the treatment, an alkaline activation bath has proved useful, containing an alkalizing agent, preferably sodium carbonate, but preferably not containing sulfite, followed by a fixing bath, preferably a bleaching-fixing bath, preferably containing ferric ammonium ethylenediamine tetraacetic acid and thiosulfate, followed by a wash water bath, preferably at a temperature of 35° C. For the purpose of the present invention, an activation bath has proved particularly useful which includes significant quantities of an organic solvent miscible with water and chosen from the solvent class comprising dihydric alcohols, polyhydric alcohols and polyoxyethyleneglycols or their mixtures, which improves the quality and constancy of the photographic results obtained (it is thought that this solvent in the activation bath prevents oxidation or that it delays its emergence from the photographic element during the development process), especially when development is carried out by treatment machines with rollers which are in contact with air.

This solvent is mixed with water in such a quantity as to form a solution containing between about 10 and 60% of the solvent itself, the optimum values being chosen according to the treatment machine used, larger organic solvent quantities having to be used the longer the time for which the film remains in contact with air (or in contact with rollers in contact with air) between the activation station and the fixing (or fixing-bleaching) station.

In accordance with the aforegoing, the present invention relates to a photographic element including a support layer, a layer of silver halide in a non-hardened gelatin including a tanning development agent spread over said layer, and, spread over said emulsion layer, a layer of non-hardened gelatin which includes at least one colored pigment dispersed therein, the silver in said silver halide being present in a quantity of less than 0.6 $g/m^2$ (usually at least 0.1 $g/m^2$), and the gelatin of said emulsion layer being present in a quantity such as to determine a silver/gelatin ratio less than 0.4. Preferred values of said silver content have proved to be values of less than 0.5, peferably less than 0.4 and more preferably between 0.2 and 0.4. Preferred values of said silver/-gelatin ratio have proved to be values less than 0.4, preferably less than 0.2 and more preferably between 0.05 and 0.15.

Preferably the colored pigment is an organic pigment, and more preferably a mixture of pigments in which the colors are chosen to form black when present in the same layer.

The present invention relates even more preferably to a photogrpahic element as heretofore described, in which the silver halide emulsion includes a significant quantity of silver chloride, preferably at least 10%, and more preferably a quantity of between 10 and 70%.

Finally the present invention also relates to method for obtaining a colored relief image in a photographic element comprising a support, a photographic emulsion layer containing silver halides in non-hardened gelatin and comprising a taning developer dispersed therein (and transmissive to radiation of a wavelength to which the silver halide is sensitive or sensitized), and, spread over said layer, a layer of non-hardened gelatin having a colored pigment dispersed therein, consisting of exposing said element to radiation, including light, and causing it to be developed by said tanning developer included in the element by using an aqueous alkaline activating solution comprising a significant quantity of a solvent chosen from the class comprising dihydric alcohols, polyhydric alcohols and polyoxyethyleneglycols or their mixtures.

Any dye or pigment used in photography which is not diffusable in the gelatin layer even when in aqueous solution, and which in itself is not reactive with the photographic emulsion to give negative phenomena such as fogging or desensitizing, can be used for the purpose of the present invention provided it is introduced by methods and with surface active agents which are compatible with the gelatin and with the silver halide emulsion used (those surface active agents known to experts of the art as dispersing agents, whether they be anionic, aionic, cationic or betainic, such as those described in Schwarty et al., *Surface Active Agents and Detergents,* Vol. I and II, Interscience Publishers, and in U.S. Pat. Nos. 2,992,108, 3,068,101, 3,201,252, 3,165,409, in French Pat. Nos. 1,556,240 and 1,497,930, in British Pat. Nos. 580,504, 985,483 and 1,274,523, and in U.S. Pat. Nos. 3,762,025 and 3,860,425), and compatible with the method for obtaining a colored relief image according to the present invention.

According to the experiments of the applicants, the use of carbon as a pigment did not prove highly desirable because it showed a certain tendency to harden on storage, causing a successive difficulty in distinguishing the exposed areas from the non-exposed areas due to hardening tanning.

Replacement of the carbon with organic pigments enabled photographic elements according to the invention to be obtained with increased stability during time. Certain organic pigments sold in aqueous dispersion proved particularly useful, such as Flexonil Blau of Hoechst, Rosso Sintosol NFRG, Arancio Velesta NPG, and Turchese Sintosol NBF of ACNA. These aqueous dispersions are prepared by suspending water-insoluble pigments in water containing a water-soluble solvent or pigment, which forms a support for the pigments concerned, as known in the art. Certain particular dye mixtures chosen to absorb red, green and blue, as known in the art, in order to form a black-colored layer proved particularly suitable for obtaining black-colored images (for example, the combination of a blue dye with a red dye, or their combination with a yellow or orange dye).

EXAMPLE 1

A photographic element for tanning development according to the present invention was obtained by spreading over a normal photographically primed polyester support a photographic layer of silver chloro-bromide lithographic emulsion optically sensitized towards green and containing 66 mol % of chloride and 34 mol % of bromide, spread in such a quantity as to provide a covering of 0.48 grams of silver per square meter, dispersed in 2.68 grams per square meter of gelatin and containing 0.8 grams per square meter of hydroquinone. Over said layer was then spread a layer of non-sensitive gelatin to give a covering of 7 grams per square meter, containing a mixture of 90% carbon Black Vulcan 3 of Cabot Co. and 10% of Perla Tusche Black Ink of Pelikan, dispersed in gelatin in such a quantity as to obtain an optical density exceeding 5 (when treated in a thiosulfate fixing bath below 20° C. and read with a Brumac TD 4S densitometer of Brumac Ind.). The element thus obtained was exposed through the support in contact with a point screen, in comparison with a conventional lithographic film having more than 5 grams of silver per square meter. The exposed element was then treated in an activation bath of the following composition for 20 seconds at 27° C.:

sodium carbonate: 90 g
water to make up to 1 liter,
and then in a stop and bleaching-fixing bath of the following composition for 10 seconds at 27° C.:
ammonium thiosulfate: 65 g
sodium bisulfite: 4.9 g
EDTA.Fe.$NH_4$: 35 g
EDTA: 2 g
25% NaOH to give a pH of 6.75
water to make up to 1 liter,
and finally washed in water for 30–40 seconds at 38° C. A microscopic examination of the point reproduced in comparison with the point obtained with the conventional lithographic film exposed under the same conditions and treated in a conventional treatment line showed a more regular and exact reproduction of the point in the element of the present invention.

EXAMPLE 2

Six photographic elements for tanning development were prepared by spreading, over different parts of a substrated polyester support, a photographic layer containing a lithographic emulsion analogous to that of Example 1 at a covering density of 1.05, 0.75, 0.58, 0.48, 0.40 and 0.28 grams of silver per square meter respectively, gelatin in a quantity to give a silver/gelatin ratio of 0.2, and hydroquinone in a quantity to give a gelatin/hydroquinone ratio of 6. A non-sensitive gelatin layer was spread over each layer thus obtained, at a covering density of 4.4 grams per square meter and containing the same mixture of pigments as Example 1 in a quantity to give an optical density exceeding 5 (when read as described in Example 1). Samples of the six elements were exposed and treated as in Example 1. The results in terms of exposure (and exposure range) necessary for obtaining a good point quality are given in the following Table.

| Element | Ag/m$^2$ | Point Quality | Exposure Range | Exposure Times |
|---|---|---|---|---|
| 1 | 1.05 | good | 0 | 0.9 sec. |
| 2 | 0.75 | " | 0 | 0.9 sec. |
| 3 | 0.58 | " | 0.2 | 1 sec.–1.2 sec. |
| 4 | 0.48 | " | 0.2 | 1 sec.–1.2 sec. |
| 5 | 0.40 | " | 0.3 | 1.2 sec.–1.5 sec. |
| 6 | 0.28 | " | 0.5 | 1.3 sec.–1.8 sec. |

This shows the dramatic improvement in exposure range with the reduced silver coating weight.

EXAMPLE 3

Six photographic elements for tanning development were prepared by spreading, over different parts of a substrated polyester support, a photographic layer containing a lithographic emulsion analogous to that of Example 1 with a covering density of 0.3 grams of silver per square meter, gelatin in such a quantity as to give a silver/gelatin ratio of 0.4, 0.3, 0.2, 0.1, 0.08 and 0.02, respectively, and hydroquinone in such a quantity as to give a gelatin/hydroquinone ratio of 6. A layer of non-sensitive gelatin analogous to that of Example 2 was spread over each layer thus obtained. Samples of the six elements obtained were exposed and treated as in Example 1. The results in terms of point quality and exposure range are given in the following Table.

| Element | Ag/gelatin | Point Quality | Exposure Range | Exposure Times |
|---|---|---|---|---|
| 1 | 0.4 | good | 0.2 | 1.1 sec.–1.3 sec. |
| 2 | 0.3 | " | 0.3 | 1.1 sec.–1.4 sec. |
| 3 | 0.2 | " | 0.3 | 1.1 sec.–1.4 sec. |
| 4 | 0.1 | excellent | 0.5 | 1.1 sec.–1.6 sec. |
| 5 | 0.08 | " | 0.6 | 1.1 sec.–1.7 sec. |
| 6 | 0.02 | " | 0.06 | 1.1 sec.–1.7 sec. |

EXAMPLE 4

Four photographic elements for tanning development were prepared by spreading, over different parts of a substrated polyester support, a photographic layer containing a lithographic emulsion analogous to that of Example 1 with a covering density of 0.35 grams of silver per square meter, gelatin in such a quantity as to give a silver/gelatin ratio of 0.1, and hydroquinone in such a quantity as to give a gelatin/hydroquinone ratio of 0.5, 2.88, 3.6 and 5.75, respectively. A layer of non-sensitive gelatin analogous to that of Example 2 was spread over each layer thus obtained. Samples of the four elements obtained were exposed for 1.2 seconds and treated as in Example 1. The following Table gives the point quality for each element.

| Element | Gelatin/hydroquinone | Point Quality |
|---|---|---|
| 1 | 0.5 | poor |
| 2 | 2.88 | poor |
| 3 | 3.6 | good |
| 4 | 5.75 | excellent |

This shows that a weight ratio of greater than 3 is preferred and greater than 4 is more preferred.

EXAMPLE 5

Three photographic elements for tanning development were prepared by spreading, over different parts of a substrated polyester support, a photographic layer containing a lithographic emulsion analogous to that of Example 1 with a covering density of 0.35 grams of silver/m$^2$, and gelatin in a quantity of 3.5 grams/m$^2$. Over each layer thus obtained was spread a non-sensitive gelatin layer containing 3 grams of gelatin/m$^2$ together respectively with 1.72 grams/m$^2$ of the pigment Arancio Sintosol NRG (commercial name of an orange pigment dispersion in an aqueous medium of the ACNA Company) in the case of element 1, 1.72 grams/m$^2$ of the pigment Rosso Sintosol NFRG (commercial name of a red pigment dispersion in an aqueous medium of the ACNA Company) in the case of element 2, and 1.72 grams/m$^2$ of the pigment Turchese Sintosol NBF (commercial name of a blue pigment dispersion in an aqueous medium of the ACNA Company) in the case of element 3. Samples of the three elements were exposed through the support by contact with a point and line screen for two seconds with a normal source of white light. Other samples of elements 1 and 2 were exposed through the non-sensitive layer by contact with an analogous screen for 12 seconds with the same source of white light, and samples of element 3 were exposed through the non-sensitive layer in contact with analogous screens for 2.5 seconds with a source of green light. All the samples thus exposed were treated in a manner analogous to Example 1. The results in terms of point and line quality, of exposure range and treatment, and of resolving power were very good in all cases.

EXAMPLE 6

A photographic element for tanning development was prepared by spreading over a normal substrated polyester support a photographic layer of silver chlorobromide lithographic emulsion in gelatin optically sensitized towards green and containing 66 mols % of chloride and 34 mols % of bromide, and spread in such a quantity as to obtain a covering density of 0.35 grams of silver/$m^2$ dispersed in 3.40 grams/$m^2$ of hydroquinone. A layer of non-sensitive gelatin was then spread over said layer with a covering density of 2.48 grams/$m^2$, together with the pigment Flexonil Blau (commercial name of a dispersion of blue pigment in an aqueous medium of the Hoechst Company) in a quantity of 3.72 grams/$m^2$, and the pigment Rosso Sintosol NFRG (commercial name of a dispersion of red pigment in an aqueous medium of the ACNA Company) also in a quantity of 3.72 grams/$m^2$. At the same time, a protective gelatin layer containing gelatin at a covering density of 1.04 grams/$m^2$ was spread over the non-sensitive layer. Samples of the element obtained were exposed through the support in contact with a screen, namely the Tint Guide of Beta Screen Corp., for times varying from 1.5 to 3 seconds, using a tungsten lamp (9 lux). The exposed samples were treated in a roller treatment machine, in an activation bath of the following composition for 30 seconds at 27° C.:

18% sodium carbonate: 250 cc
ethylene glycol: 250 cc, then in a stop and bleaching-fixing bath of the same composition as Example 1 for 25 seconds at 27° C., and finally washed with hot water at 43° C. In each of said samples, a black-colored relief image is obtained which is negative with respect to the screen used for the exposure, has an excellent point and line quality and an exposure range of 0.9 with a resolving power of 120 lines/mm and a maximum density greater than 4. The same treatment was repeated for samples of the aforesaid element preserved for 15 hours at 50° C., and for samples kept under ambient temperature conditions for one month. The exposure and treatment performed on the fresh samples were repeated on these samples, with analogous results. On evaluating the spreading quality of the film and the point quality obtained with it, it was found that the element of this Example was better than an element which was completely analogous except for the presence of the protective layer spread over the non-sensitive gelatin layer. In both cases, the presence of ethylene glycol in the activation bath had a determining effect in terms of obtaining a good point quality when the elements were treated in a roller treating machine.

EXAMPLE 7

An element for tanning development was prepared in a manner analogous to that described in the preceding Example using the pigments Flexonil Blau and Rosso Sintosol NFRG in a quantity of 2.66 grams/$m^2$ together with the pibment Arancio Velesta NPG (commercial name of a dispersion of an orange pigment in an aqueous medium of the ACNA Company) in a quantity of 2.13 grams/$m^2$. When exposed and treated in a manner analogous to those of the preceding Example, the samples obtained gave analogous results. In their case, a spreading quality and point quality were again obtained which were better than those obtained with analogous photographic elements but without the protective gelatin layer spread over the non-sensitive gelatin layer containing the pigments. The presence of ethylene glycol was determined in terms of obtaining a good image quality in roller treatment machines.

We claim:

1. A photographic element comprising a support layer and spread over said support, a layer of silver halide emulsion in non-hardened gelatin with a tanning developer dispersed therein and, spread over said emulsion layer, a layer of non-hardened gelatin having at least one colored pigment dispersed therein, the silver of said layer of silver halide emulsion being present in a quantity of less than 0.6 grams per square meter, and the gelatin of said emulsion layer being present in a quantity such as to provide a silver/gelatin ratio of less than 0.4.

2. A photographic element as claimed in claim 1, wherein said silver halide comprises at least 10% by weight of silver chloride.

3. A photographic element as claimed in claim 1, wherein said tanning developer is a hydroquinone compound.

4. A photographic element as claimed in claim 1, wherein said colored pigment is an organic pigment.

5. A photographic element as claimed in claim 4, wherein said colored pigment is constituted by a plurality of pigments, the colors of which are chosen such as to be black when they are present in the same layer.

6. A photographic element as claimed in claims 2, 3 or 4, wherein a protective gelatin layer is spread over said non-sensitive gelatin layer.

7. A photographic element as claimed in claims 1, 3 or 4, wherein the silver content of said silver halide emulsion layer lies between 0.2 and 0.4 grams per square meter and the weight ratio of gelatin to tanning developer is between 3 and 8.

8. A photographic element as claimed in claim 7, wherein the silver/gelatin ratio is less than 0.2.

9. A method for obtaining a colored relief image in the photographic element of claim 1, comprising exposing said element and promoting its development by said tanning developer contained in the element by contacting the exposed element with an aqueous alkaline solution comprising a significant quantity of a solvent chosen from the class including dihydric alcohols, polyhydric alcohols and polyoxyethyleneglycols or their mixtures.

* * * * *